United States Patent [19]

Hirota et al.

[11] 4,428,494

[45] Jan. 31, 1984

[54] EASILY-OPENABLE HEAT SEAL LID

[75] Inventors: Kazumi Hirota, Tokyo; Yotaro Tsutsumi, Yokohama; Senji Itoh, Ayase; Tadahiko Katsura, Yokohama; Kikuo Matsuoka, Yokohama; Ichiro Hori, Yokohama; Toshihiko Hayashi, Yokohama, all of Japan

[73] Assignee: Toyo Seikan Kaisha, Ltd., Tokyo, Japan

[21] Appl. No.: 434,726

[22] Filed: Oct. 18, 1982

[30] Foreign Application Priority Data

Oct. 19, 1981 [JP] Japan ..... 56-165833

[51] Int. Cl.[3] ..... B65D 17/34

[52] U.S. Cl. ..... 220/270; 220/260

[58] Field of Search ..... 220/260, 269–273, 220/359; 156/257

[56] References Cited

U.S. PATENT DOCUMENTS 3,632,461 6/1972 Gayner et al. ..... 220/270

3,765,561 10/1973 Hekal et al. ..... 220/270

*Primary Examiner*—George T. Hall

*Attorney, Agent, or Firm*—Sherman & Shalloway

[57] ABSTRACT

Disclosed is an easily openable heat seal lid for sealing a vessel proper by forming a heat-sealed portion between the lid and the vessel proper, which comprises a laminate comprising at least an inner face member composed of a thermoplastic resin and a metal foil, wherein scores defining a portion to be opened are formed on the side inner than the portion to be heat-sealed so that the scores extend to the midway of the thickness direction of the metal foil, an opening tab is formed on the portion of the lid to be opened through a bonding fulcrum portion composed of a thermoplastic resin hot adhesive so that the push-tearing top end of the opening tab is located on the scores, and the peel strength between the opening tab and the lid in said bonding portion is at least 0.4 Kg/5 mm.

5 Claims, 5 Drawing Figures

Fig. 4-A
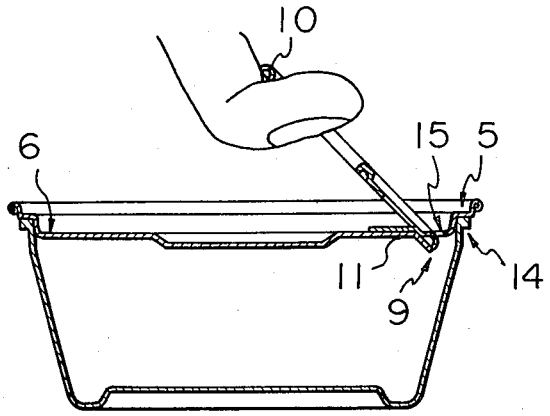
Fig. 4-B
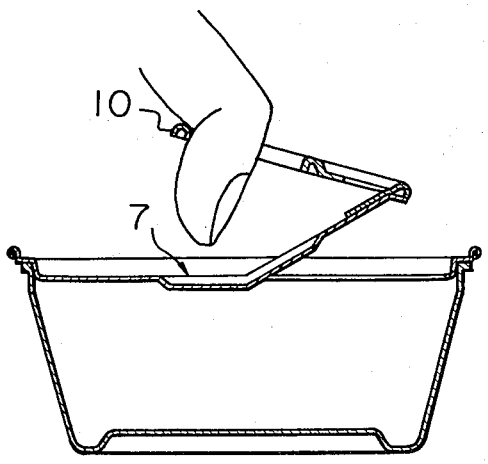

EASILY-OPENABLE HEAT SEAL LID

BACKGROUND OF THE INVENTION (1) Field of the Invention

The present invention relates to an easily-openable heat seal lid. More particularly, the present invention relates to a heat seal lid having a high heat seal strength and a good easy openability and the lid and can resist sterilizing treatments, for example, heat sterilizing and hot packing treatments.

(2) Description of the Prior Art

A heat seal lid having a sealing capacity and an easy-open property, for example, a so-called peelable seal lid, is known. This peelable seal lid comprises a flexible substrate such as a metal foil and a heat-sealant layer formed on the substrate. A composition formed by incorporating a wax, a tackifier and an elastomer into an olefin resin such as polyethylene, in which the seal strength is adjusted to about 1 Kg/15 mm, is ordinarily used as the heat sealant. A peelable seal lid of this type is defective in that when the content is packed and heat sterilization is carried out, the seal reliability of the lid is poor. In Official Notice No. 17 of the Welfare Ministry of Japan (enforced on Aug. 1, 1977), it is stipulated that a food vessel which is heat-sealed and subjected to heat sterilization should have a heat seal strength of at least 2.3 kg/15 mm.

A heat seal lid sealed with such a high seal strength is disadvantageous in that peeling on the heat seal interface is manually impossible and therefore, opening is performed by a tool such as a knife or a can opener.

As the lid that can easily be opened manually without using any instrument, there is known a so-called easy-open can lid. In this can lid, an opening portion is defined by scores as a lid formed of an aluminum sheet, a rivet is formed on the opening portion and a pull ring is secured by this rivet of the opening portion, and this can lid is double-seamed to a flange portion of a can body.

This easy-open can lid can resist heat sterilization under pressure and has an excellent easy-open property. However, this can lid is defective in that a large quantity of expensive metallic aluminum should be used as the material, the severe processing steps are complicated and troublesome and the cost is considerably higher than that of the above-mentioned flexible heat seal lid.

Moreover, vessels to which this easy-open lid can be applied are limited to those having a high heat resistance, for example, cans. For example, when this easy-open lid is double-seamed to a plastic cup-like vessel formed by drawing, it is impossible to form a seal having a high reliability, and when the cup-like vessel is subjected to hot packing or retort sterilization, since the flange of the cup is softened at high temperatures adopted for such treatment, formation of a reliable seal becomes more difficult.

SUMMARY OF THE INVENTION

It is therefore a primary object of the present invention to provide an easily-openable heat seal lid composed of a laminate sheet having a high heat seal strength and a good easy openability, which can be subjected to a hot packing treatment and a heat sterilizing treatment.

Another object of the present invention is to provide an easily-openable heat seal lid in which at the time of opening, a laminate sheet can be broken smoothly and beautifully along a predetermined opening line.

Still another object of the present invention is to provide an easily-openable heat seal lid which is preferably used for vessels to which double seaming is difficult, for example, plastic vessels and aluminum foil vessels.

A further object of the present invention is to provide an easily-openable heat seal lid in which the amount used of an expensive metal material is reduced, the lid-forming operation is simplified and the manufacturing cost can be controlled to a relatively low level.

In accordance with the present invention, there is provided an easily-openable heat seal lid for sealing a vessel proper by forming a heat-sealed portion between the lid and the vessel proper, which comprises a laminate comprising at least an inner face member composed of a thermoplastic resin and a metal foil, wherein scores defining a portion to be opened are formed on the side inner than the portion to be heat-sealed so that the scores extend to the midway of the thickness direction of the metal foil, an opening tab is formed on the portion of the lid to be opened through a bonding fulcrum portion composed of a thermoplastic resin hot adhesive so that the push-tearing top end of the opening tab is located on the scores, and the peel strength between the opening tab and the lid in said bonding portion is at least 0.4 Kg/5 mm.

The present invention will now be described in detail with reference to embodiments illustrated in the accompanying drawings.

BRIEF DESCRIPTION OF THE DRAWINGS

FIG. 4-A and FIG. 4-B are diagrams illustrating the operation of opening the vessel lid of the present invention.

DETAILED DESCRIPTION OF THE PREFERRED EMBODIMENTS

Figure 1:
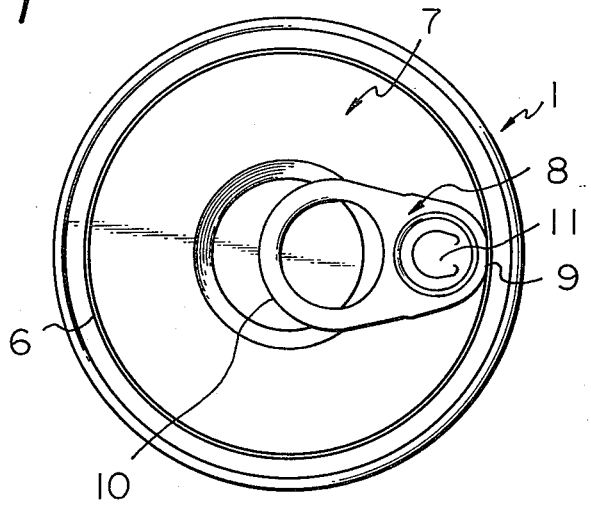
FIG. 1 is a plan view showing the vessel lid of the present invention.
Figure 2:
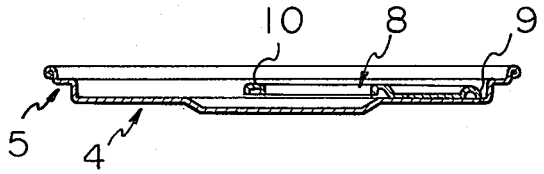
FIG. 2 is a sectional side view showing the vessel lid of the present invention.
Figure 3:
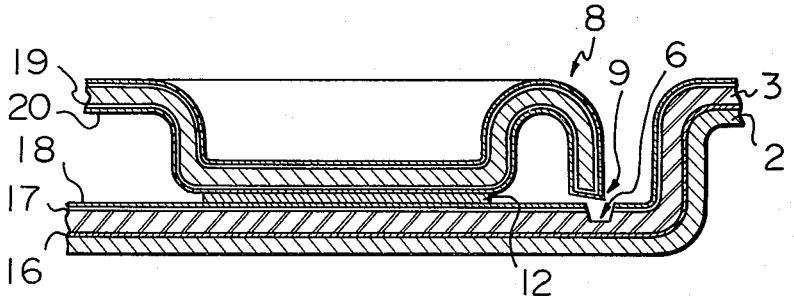
FIG. 3 is an enlarged sectional view showing a part of the vessel lid of FIG. 2.

As shown in FIGS. 1, 2 and 3, a heat seal lid 1 according to the present invention comprises a laminate 4 comprising an inner face member 2 composed of a thermoplastic resin and a metal foil 3. This lid has a portion 5 to be heat-sealed and a portion 7 to be opened, which is located on the inner side of the portion 5 to be heat-sealed and is defined by scores 6. As shown in the enlarged sectional view of FIG. 3, the scores 6 are formed so that they extend to the midway of the thickness direction of the metal foil 3, and at the time of opening, the scores 6 can easily be broken.

According to the present invention, an opening tab 8 is formed on the portion 7 to be formed in a special manner described below. The opening tab 8 has a score-push-tearing top end 9 on one end, a holding part (ring) 10 on the other end and a fulcrum portion 11 to be bonded to the lid. The opening tab 8 is heat-bonded to the portion 7 of the lid to be opened at the fulcrum portion 11 through a thermoplastic resin adhesive layer 12 so that the push-tearing top end 9 of the opening tab 8 is located in agreement with the scores 6 of the lid. It is important that the fulcrum portion 11 for bonding the opening tab 8 to the portion 7 of the lid should have a peel strength of at least 0.4 Kg/5 mm, especially at least 1.0 Kg/5 mm.

In the present invention, by adopting the above-mentioned structure, opening of the lid in the portion other than the heat seal portion can easily be accomplished. As shown in FIGS. 4-A and 4-B illustrating the opening operation, the vessel lid 1 of the present invention is sealed to and engaged with the vessel proper by heat-sealing the portion 5, to be heat-sealed, of the lid to the flange portion 14 of the vessel proper 13, and by gripping the holding part 10 of the opening tab 8 with the finger and pulling it upward, the force is transmitted as a downward force to the push-tearing top end 9 through the fulcrum portion 11 and a cut 15 (see FIG. 4-A) is formed in the scores 5. When the cut 15 is formed in the scores 6, the scores 6 can easly be broken along the line of the scores 6. Accordingly, if the holding part 10 of the opening tab 8 is gripped and pulled by the finger, as shown in FIG. 4-B, the portion 7 to be opened can be removed precisely and easily.

In the present invention, in order to attain a good easy openability, it is important that the push-tearing top end, of the opening tab should be located on the scores 6 partially cut into the metal foil 3 of the lid, the opening tab 8 should be formed on the portion 7 to be opened of the lid through the bonding fulcrum point 11, and that the peel strength in the bonding fulcrum point 11 should be at least 0.4 Kg/5 mm of the width.

For example, in the case where an opening tab is heat-bonded to a portion of a lid defined by scores and this opening tab is pulled, as taught in Japanese Utility Model Publication No. 524/76, it is difficult to form a cut in the scores and break the scores, but by pressing downward the scores by a sharp top end, it is made easy to form a cut in the scores. A fulcrum point is necessary for giving a downward pressing force to the push-tearing top end 9 of the opening tab 8. In the vessel lid of the present invention, since the vessel lid is formed of a flexible laminate, even if the opening tab 8 is secured to the portion 7 to be opened of the lid by bonding, at the opening operation, the portion precedent to the bonding portion 11 is deformed as the fulcrum and the leverage action is effectively exerted. At the time of opening, a peeling force should naturally be imposed on the bonding portion 11 between the opening tab 8 and the portion 7 to be opened of the lid. In the present invention, by imparting a peel strength of at least 0.4 Kg/5 mm to the bonding portion 11, it is made possible to push-tear the scores 6 while preventing the bonding portion 11 from being peeled.

The kind of the laminate sheet 4 used for the lid of the present invention is not particularly critical, so far as it comprises a heat-sealable inner face member 2 and a metal foil 3. In the embodiment illustrated in the accompanying drawings, a heat-sealable inner face member 2 is bonded through an adhesive layer 16 to the surface of a metal foil 3 on the side to be formed into an inner face side of the resulting packaging material, and a primer coating layer 18 is formed on the other surface of the metal foil 3 through a surface treatment layer 17.

In the embodiment illustrated in the accompanying drawings, a primer coating layer 20 is formed also on the opening tab 8 through a surface treatment layer 19 on the metal substrate. In accordance with this preferred embodiment of the present invention, the opening tab 8 is bonded to the portion 7 to be opened of the lid through the surface treatment layer 19, the primary layer 20, the hot adhesive layer 12, the primer layer 18 and the surface treatment layer 17, which are arranged in this order, and even after a severe treatment such as retort sterilization, the peel strength of the bonding fulcrum portion 11 can be maintained at a level of at least 0.4 Kg/5 mm.

In the present invention, a foil of a light metal such as an aluminum foil is preferably used as the metal foil. Of course, other metal foils, such as an iron foil, a steel foil and a tinplate foil may be used. From the viewpoint of the resistance to heat sterilization, it is preferred that the metal foil be subjected to a preliminary treatment such as an alumite treatment, a boehmite treatment, a chemical treatment with phosphoric acid and/or chromic acid or a forming treatment to form a surface treatment layer 18 as mentioned above.

The metal foil should have a certain rigidity enough to enable tearing along scores. From this viewpoint, it is preferred that the thickness of the metal foil be at least 50μ, especially at least 80μ. From the economical viewpoint and in order to prevent hurting of fingers and the like at the time of opening, it is preferred that the thickness of the metal foil be up to 200μ, especially up to 150μ.

From the viewpoints of the gas barrier property, the compression resistance and the resistance to falling shocks, it is important that the scores 6 formed on the metal foil should remain in the midway of the thickness direction of the metal foil. When the easy-open property is taken into account together with the above characteristics, it is preferred that the depth of the scores be 3/10 to 7/10, especially 2/5 to 3/5, of the thickness of the metal foil and that the thickness of the scored portion of the metal foil be at least 20μ, especially at least 30μ.

A polyolefin resin, especially a propylene resin or a ethylene resin are employed as the heat-sealable inner face member 2. An isotactic polypropylene is especially preferred as the heat-sealable inner face member 2. However, a crystalline propylene/ethylene copolymer having an ethylene content of up to 15 mole %, especially up to 10 mole %, or polyethylene can also be used as the polyolefin resin. When a propylene resin is used as the polyolefin resin, it is ordinarily preferred that the propylene resin should have a melt index (ASTM D-1238) of 5 to 100 g/10 min. If the thickness of the film of the propylene resin is too large, tearing of the laminate along the scores becomes difficult, and if the thickness is too small, the heat sealability is reduced. Accordingly, it is preferred that the thickness of the film of the propylene resin be 30 to 150μ, especially 50 to 100μ.

An acid-modified propylene resin is most preferably used as the adhesive 16 for the heat-sealable inner face member, and the propylene resin layer is fusion-bonded to the metal foil through this acid-modified propylene resin.

More specifically, if a propylene resin is selected for the heat-sealable inner face member and this inner face member is fusion-bonded to the metal foil through a layer of an acid- or acid anhydride-modified olefin resin in which the main structural olefin monomer is propylene (hereinafter referred to as "acid-modified propylene resin"), the laminate sheet can be torn more precisely and easily along scores than when any of other combinations of the inner face member and the adhesive layer is used.

Namely, when a propylene resin film is fusion-bonded to a metal foil through an acid-modified propylene resin, occurrence of delamination, that is, interlaminar peeling, is prevented more effectively than when the film is fusion-bonded to the metal foil through any of other adhesive layers. It is known that isocyanate adhesives give optimum results as the adhesive for bonding a propylene resin film to a metal foil. When a laminate formed by bonding a propylene film to a metal foil through an isocyanate adhesive is subjected to retort sterilization and the laminate is torn along scroes by hands, peeling is caused between the metal foil and the propylene resin film. If this interlaminar peeling is caused in the torn portion of the laminate, the metal foil and the film are separately torn in directions different from the direction of the score line. Accordingly, it is difficult to open the lid by smoothly tearing the laminate precisely along the scores, and fragments or feather-like pieces of the resin film are left on the opening.

The easiness of tearing of the laminate is influenced also by the elongation of a film formed on a metal foil. In case of a laminate formed by bonding polypropylene to a metal foil through an isocyanate adhesive, because of too large an elongation of the film, it is made difficult to sharply tear the laminate along the scores.

The propylene resin used in this preferred embodiment has such a characteristic chemical structure that in the polymer chain, tertiary carbon atoms appear alternately, and because of this characteristic, the propylene resin is subject to thermal degradation. This propylene resin is further characterized in that crystallization is readily advanced at high temperatures.

If a film of this propylene resin is fusion-bonded to a metal foil through an acid-modified propylene resin layer, since the acid-modified propylene resin contains a carboxyl group having a high affinity with the metal foil and the main constituent olefin units of the acid-modified propylene resin are the same as those of the propylene resin, a strong interlaminar bonding that can resist retort sterilization or tearing can be obtained. Furthermore, the elongation of the film is controlled by the thermal degradation or crystallization of the propylene resin caused at the fusion-bonding step. Therefore, precise and smooth tearing along the scores becomes possible.

A preferred acid-modified propylene resin contains a carboxyl group or its anhydride at a concentration of 1 to 600 milliequivalents (meq)/100 g of the polymer, especially 10 to 300 meq/100 g of the polymer. In view of the easy-open property and the heat bondability, it is preferred that the modified propylene resin should have a melt index of at least 5 g/10 min.

As the acid or anhydride, the following compounds may be used singly or in combination.

(A) Ethylenically unsaturated carboxylic acids such as acrylic acid, methacrylic acid, maleic acid, fumaric acid, crotonic acid, itaconic acid, citraconic acid and 5-norbornene-2,3-dicarboxylic acid.

(B) Ethylenically unsaturated carboxylic anhydrides such as maleic anhydride, citraconic anhydride, 5-norbornene-2,3-dicarboxylic anhydride and tetrahydrophthalic anhydride.

Maleic anhydride-modified polypropylene is especially suitable for attaining the objects of the present invention.

The modifying treatment is accomplished by introducing the above-mentioned monomer into the main or side chain of the olefin resin by known means such as graft copolymerization or terminal treatment. For example, a modified propylene resin can easily be obtained by contacting a trunk polymer composed of a propylene resin with an acid group-containing ethylenically unsaturated monomer in the presence of a radical initiator or radical initiating means. The modified propylene resin is interposed in the thickness of 0.5 to 20μ, especially 1 to 10μ, between the metal foil and the olefin resin layer.

For fusion bonding, there may be adopted a method in which a modified propylene resin is coated in the form of a film, powder, dispersion or solution on a metal foil, the coating is heated to melt the modified olefin resin, and a preformed film of a propylene resin is piled on the melt and is fusion-bonded to the metal foil. Coating of the modified propylene resin is performed by electrostatic coating, electrophoretic coating, roll coating, dip coating, bar coating, spray coating or fluidized dipping. Furthermore, the co-extrusion coating method can be adopted. Heating of the coated metal foil is accomplished by high frequency induction heating, infrared ray heating or hot air furnace heating.

Instead of the method in which the modified propylene resin and the propylene resin are independently applied to the metal foil, there may be adopted a method in which both the resins are co-extruded through a multi-ply die and the extruded two-layer film is heat-fusion-bonded to the metal film.

Of course, in the present invention, if the above-mentioned disadvantages are permissible or not seriously significant, other material such as low-density, medium-density or high-density polyethylene may be used for the heat-sealable inner face member 2, and a urethane adhesive or other material may be used for the adhesive layer 17.

As the primer 18 to be applied to the metal foil, there can be used optional paints comprising thermosetting and thermoplastic resins, for example, modified epoxy paints such as phenol-epoxy paints and amino-epoxy paints, vinyl and modified vinyl paints such as vinyl chloride/vinyl acetate copolymer paints, partially saponified vinyl chloride/vinyl acetate copolymer paints, vinyl chloride/vinyl acetate/maleic anhydride copolymer paints, epoxy-modified epoxyamino-modified vinyl resin paints and epoxy-modified epoxyphenol-modified vinyl resin paints, acrylic resin paints, and synthetic rubber paints such as styrene-butadiene copolymer paints.

These paints are applied in the form of an organic solvent solution such as a lacquer or enamel or an aqueous dispersion or solution by spray coating, dip coating, electrostatic coating or electrophoretic coating. Of course, when a thermosetting resin paint is used, the coating is baked according to need.

The opening tab 8 may be formed by punching, bending or other processing of a metal blank such as aluminum, tinplate or tin-free steel. The surface treatment of the tab 8 and the coating of the primer may be conducted in the same manner as in case of the metal foil.

As the adhesive 12 to be used for heat-bonding the opening tab 8 to the portion 7 to be opened of the lid, there can be used heat-fusion-bondable thermoplastic resins, especially thermoplastic resins having a melting or softening point of 110° to 270° C., particularly 150° to 240° C.

Preferred examples of such thermoplastic polymer are described below, though polymers that can be used in the present invention are not limited to those exemplified be below.

(a) Polyesters comprising recurring units represented by the following general formula:

$$\left(O-R_1-O-\overset{O}{\overset{\|}{C}}-R^2-\overset{O}{\overset{\|}{C}}\right) \quad (1)$$

or $$\left(O-R_1-O-R_2-\overset{O}{\overset{\|}{C}}\right) \quad (2)$$

wherein $R_1$ stands for an alkylene group having 2 to 6 carbon atoms and $R_2$ stands for an alkylene or arylene group having 2 to 24 carbon atoms.

For example, there can be mentioned polyethylene terephthalate, polyethylene terephthalate/adipate, polyethylene terephthalate/sebacate, polytetramethylene terephthalate, polytetramethylene isophthalate, polytetramethylene terephthalate/isophthalate, polyethylene terephthalate/isophthalate, polytetramethylene/ethylene terephthalate, polyethylene/tetramethylene terephthalate/isophthalate and polyethylene hydroxybenzoate.

(b) Homopolymers or copolymers of monomers represented by the following general formula:

$$CH_2=C\begin{matrix} R_3 \\ C-O-R_4 \\ \| \\ O \end{matrix} \quad (3)$$

wherein $R_3$ stands for a hydrogen atom or lower alkyl group and $R_4$ stands for a hydrogen atom or an alkyl group having 1 to 12 carbon atoms, or copolymers or acrylic-modified polyolefins comprising monomers of the above formula (3) and olefins or other vinyl monomers.

For example, there can be mentioned polyacrylic acid esters, polymethacrylic acid esters, ethylene/acrylic acid ester copolymers, acrylic acid ester/acrylic acid copolymers, ethylene/acrylic acid copolymers, styrene/methacrylic acid ester/acrylic acid copolymers, acrylic acid ester/vinyl chloride copolymer, acrylic acid ester-grafted polyethylene, methacrylic acid ester/vinyl chloride copolymers, styrene/methacrylic acid ester/butadiene copolymers and methacrylic acid-/acrylonitrile copolymers.

(c) Copolymers of vinyl esters represented by the following general formula:

$$CH_2=CH-O-\overset{O}{\overset{\|}{C}}-R_5 \quad (4)$$

wherein $R_5$ stands for a hydrogen atom or an alkyl or phenyl group, with olefins or other vinyl monomers or partial saponification products thereof.

For example, there can be mentioned partially saponified ethylene/vinyl acetate copolymers, ethylene/vinyl propionate copolymers, ethylene/vinyl acetate copolymers, acrylic acid ester/vinyl acetate copolymers and vinyl chloride/vinyl acetate copolymers.

(d) Ionomers (ion-crosslinked olefin copolymers) obtained by neutralizing copolymers of olefins with unsaturated carboxylic acids, optionally together with other vinyl monomers, by an alkali metal, an alkaline earth metal or an organic base, for example, Surlyns supplied by Du Pont Co., U.S.A.

(e) Copolymers of maleic anhydride with other vinyl monomers and maleic anhydride-modified polyolefins, such as maleic anhydride/styrene copolymers, maleic anhydride-modified polypropylene and maleic anhydride-modified polyethylene.

(f) Polycarbonates having recurring units represented by the following formula:

$$\left(O-R_6-O-\underset{O}{\underset{\|}{C}}\right) \quad (5)$$

wherein $R_6$ represents a hydrocarbon group having 8 to 15 carbon atoms.

For example, there can be mentioned poly-p-xylene glycol biscarbonate, poly-dihydroxydiphenylmethane carbonate, polydihydroxydiphenylethane carbonate, poly-dihydroxydiphenyl-2,2-propane carbonate and poly-dihydroxydiphenyl-1,1-ethane carbonate.

(g) Polyamides having recurring units represented by the following general formula:

$$\left(NH(CH_2)_n-\overset{O}{\overset{\|}{C}}\right) \quad (6)$$

or $$\left(NH(CH_2)_n-NH-\overset{O}{\overset{\|}{C}}(CH_2)_m-\overset{O}{\overset{\|}{C}}\right) \quad (7)$$

wherein n is a number of from 3 to 13 and n is a number of from 4 to 11.

For example, there can be mentioned poly-ω-aminocaproic acid, poly-ω-aminoheptanoic acid, poly-ω-aminocaprylic acid, poly-ω-aminopelargonic acid, poly-ω-aminodecanoic acid, poly-ω-aminoundecanoic acid, poly-ω-aminotridecanoic acid, polyhexamethylene adipamide, polyhexamethylene sebacamide, polyhexamethylene dodecamide, polyhexamethylene tridecamide, polydecamethylene adipamide, polydecamethylene sebacamide, polydecamethylene dodecamide, polydecamethylene tridecamide, polydodecamethylene adipamide, polydodecamethylene sebacamide, polydodecamethylene dodecamide, polydodecamethylene tridecamide, polytridecamethylene adipamide, polytridecamethylene sebacamide, polytridecamethylene dodecamide, polytridecamethylene tridecamide, polyhexamethylene azelamide, polydodecamethylene azelamide and polytridecamethylene azelamide, and copolyamides thereof.

These thermoplastic polymers may be used singly or in the form of a blend of two or more of them.

Hot adhesives especially suitable for attaining the objects of the present invention are a copolyester and a polyamide.

Furthermore, there may be adopted a method in which the acid-modified olefin resin (c) or (e) is used as the heat-bondable primers 18 and 20, an olefin resin having the same structural olefin units as those of the acid modified olefin resin is used as a hot adhesive, and both the resins are heat-bonded to each other.

Heat bonding of the opening tab 8 to the lid 1 can easily be accomplished by bonding an adhesive layer 12 to the opening tab 8 in advance, piling the assembly on the lid 1 at the above-mentioned position, pressing the assembly under heating by high frequency induction heating, infrared ray heating or conduction of heat from a heating member, and, if necessary, cooling the bonded structure. Of course, the hot adhesive layer 12 may be formed on the lid 1 in advance, or the hot adhesive layer 12 may be interposed between the opening tab 8 and the lid 1 at the heat-bonding step.

The lid of the present invention is advantageously used as a heat seal lid for sealing optional vessels, for example, a metal can, a plastic vessel, a metal foil vessel, a metal foil/plastics composite vessel and a paper/plastics/aluminum foil composite vessel. The lid of the present invention is especially advantageously used for sealing easily buckling vessels in which double seaming is impossible and packaging vessels which should be subjecting to hot packing and heat sterilization. More particularly, the lid of the present invention is preferably used as a heat seal lid for a plastic cup obtained by vacuum forming, a monoaxially or biaxially drawn plastic cup obtained by plug assist forming or air-pressure forming, a metal foil vessel formed by drawing and a vessel having a side seam, which is composed of a flexible material.

Incidentally, the shape of the scores is not limited to a circular, square or rectangular shape for opening the entire inside of the seal portion, but there may be adopted a method in which scores are formed in a shape of a small circle or water drop only on a part of the inside of the seal portion. In this case, opening is effected from this small circular or rain drop-like scored part.

In the vessel lid of the present invention, since the portion to be opened is formed independently from the heat seal portion, it is possible to form a heat seal portion which can fully resist a sterilization treatment such as hot packing, hot water sterilization or retort sterilization, and a high seal reliability can be maintained. Accordingly, a packed food can be stored stably for a long time, and opening can be performed very easily and assuredly. Therefore, great advantages can be attained according to the present invention.

Excellent effects of the present invention will now be described in detail with reference to the following Examples that by no means limit the scope of the invention.

Lids and tabs used in Examples 1 through 14 and Comparative Examples 1 through 7 are collectively shown in Tables 1 and 2.

The peel strength was determined according to the following procedures. A test piece having a width of 5 mm and a length of 70 mm was taken out from the lid, and this test piece was piled on a tab so that the side of the test piece to be bonded to the tab (the side to be formed into an outer face of the vessel) confronted the side of the tab to be bonded to the lid. An adhesive having a width of 10 mm and a length of 50 mm was inserted between the test piece and the tab, and the assembly was heated for 0.5 second by high frequency induction heating to effect bonding and form a test piece for the measurement of the peel strength. The test piece was tested at a pulling speed of 500 mm/min by an Instron type tensile tester to determine the peel strength.

The whitening resistance at the hot water treatment or retort treatment was evaluated according to the following procedures.

A test piece having a size of 5 cm×10 cm was taken out and the test piece was immersed in city water in a beaker. The beaker was covered with an aluminum foil and the test piece was boiled for 30 minutes. The whitening state of the primer-coated surface was examined and evaluated.

The whitening resistance at the retort treatment was carried out in the following manner. A test piece similar to that used above for determining the whitening resistance at the hot water treatment was immersed in city water in a beaker and the retort treatment was carried out at 121° C. for 30 minutes in a pressure sterilization vessel.

The whitening resistance at the hot water treatment or retort treatment was evaluated according to the following scale:

○: no whitening
◎: slight whitening
Δ: relatively prominent whitening
X: prominent whitening.

TABLE 1

| | Lid | | | Tab | | | Peel Strength (Kg/5 mm) | |
|---|---|---|---|---|---|---|---|---|
| | Primer | Drying and Curing Conditions | Whitening Resistance at Retort Treatment | Primer | Drying and Curing Conditions | Adhesive | Before Retort Treatment | After Retort Treatment |
| Example 1 | epoxyphenol | 250° C., 30 seconds | ◎ | epoxyphenol | 265° C., 45 seconds, | nylon | 2.3 | 2.2 |
| Example 2 | modified vinyl | 250° C., 30 seconds | ◎ | modified vinyl | 250° C., 45 seconds | " | 1.9 | 1.9 |
| Example 3 | epoxyurea | 250° C., 30 seconds | ◎ | epoxyurea | 250° C., 45 seconds | acid-modified polypropylene | 1.4 | 1.4 |
| Example 4 | epoxyphenol | 250° C., 30 seconds | ◎ | epoxyphenol | 265° C., 45 seconds | polyester | 2.6 | 2.5 |
| Example 5 | epoxy ester | 250° C., 30 seconds | ◎ | " | 265° C., 45 seconds | " | 2.3 | 2.2 |
| Example 6 | " | 250° C., 30 seconds | ◎ | modified vinyl | 250° C., 45 seconds | " | 2.0 | 1.9 |
| Example 7 | phenolic resin-modified epoxyurea | 250° C., 30 seconds | ◎ | phenolic resin-modified epoxyurea | 265° C., 45 seconds | " | 1.6 | 1.6 |
| Example 8 | epoxyphenol | 250° C., 30 seconds | ◎ | epoxyphenol | 265° C., 45 seconds | nylon | 2.4 | 2.3 |
| Example 9 | " | 250° C., 30 seconds | ◎ | " | 265° C., 45 seconds | " | 2.5 | 2.3 |
| Comparative Example 1 | " | 250° C., 30 seconds | ◎ | " | 265° C., 45 seconds | " | 0.1 | — |
| Comparative Example 2 | epoxyurea | 250° C., 30 seconds | ◎ | " | 265° C., 45 seconds | acid-modified polypropylene | 0.8 | 0.05 |

TABLE 1-continued

| | Lid | | | Tab | | Peel Strength (Kg/5 mm) | | |
|---|---|---|---|---|---|---|---|---|
| | Primer | Drying and Curing Conditions | Whitening Resistance at Retort Treatment | Primer | Drying and Curing Conditions | Adhesive | Before Retort Treatment | After Retort Treatment |
| Comparative Example 3 | " | 250° C., 30 seconds | ⊚ | " | 265° C., 45 seconds | nylon | 0.1 | — |

TABLE 2

| | Lid | | | | Tab | | | Peel Strength (Kg/5 mm) | |
|---|---|---|---|---|---|---|---|---|---|
| | Primer | Drying and Curing Conditions | Whitening Resistance boiling | Whitening Resistance retorting | Primer | Drying and Curing Conditions | Adhesive | Before Retort Treatment | After Retort Treatment |
| Example 10 | vinyl chloride organosol | 230° C., 45 seconds | ⊚ | ○ | epoxyphenol | 265° C., 45 seconds | polyester | 2.2 | 2.2 |
| Example 11 | maleic anhydride-modified vinyl chloride-vinyl acetate copolymer | 230° C., 45 seconds | ⊚ | Δ | " | 265° C., 45 seconds | " | 1.8 | 1.7 |
| Example 12 | acid-modified polypropylene | 200° C., 10 seconds | ⊚ | ○ | acid-modified polypropylene | 200° C., 10 seconds | polypropylene | 1.5 | 1.4 |
| Example 13 | not applied | — | X blackening | X balckening | not applied | — | acid-modified polypropylene | 1.2 | 1.2 |
| Comparative Example 4 | " | — | X blackening | X blackening | " | — | polyester | 0.2 | 0.05 |
| Comparative Example 5 | " | — | X blackening | X blackening | " | — | nylon | 0.1 | 0 |

EXAMPLE 1

54 g of p-cresol was mixed with 46 g of carbolic acid and 97.3 g of formaldehyde (37% aqueous solution), and 27 g of ammonia (28% aqueous solution) was added to the mixture as a catalyst and reaction was carried out at 95° to 100° C. for 3.5 hours to obtain a phenol-formaldehyde resin of a so-called B-stage.

This phenol-formaldehyde resin and an epoxy resin (Epikote #1009 supplied by Shell Chemical Co.; epoxy equivalent=2850) were dissolved at a weight ratio of 35/65 in a mixed solvent (comprising 50 parts of xylene and 10 parts of MEK) to form an epoxyphenol type primer composition having a solid content of 30%. The primer composition was coated in a thickness of 5±1 microns on one surface of an aluminum foil having a thickness of 100 microns, which had been subjected to a surface treatment with phosphoric acid and chromic acid, by means of a roll coater, and was heated and cured at 250° C. for 30 seconds in a hot air oven.

A polypropylene film having a thickness of 50μ was heat-bonded to the surface of the aluminum foil, opposite to the primer-coated surface, through a maleic anhydride-modified polypropylene film having a thickness of 10μ, and the laminate was cooled for 3 seconds by a cooling roll to form a lid material.

The above-mentioned primer composition was coated in a dry thickness of 4±1 microns on the surface, to be bonded to the lid, of an aluminum foil having a thickness of 0.4 mm, which had been subjected to a surface treatment with phosphoric acid and chromic acid, by means of a roller coater, and was heated and cured at 265° C. for 45 seconds to form a tab material.

Test pieces for the measurement of the peel strength and the determination of the whitening resistance at the retort treatment were cut out from the so-prepared lid and tab materials, and the peel strength and the whitening resistance at the retort treatment were determined. The obtained results are shown in Table 1. It was found that the peel strength after the retort treatment was sufficient for a practically applicable lid and the whitening resistance at the retort treatment was good.

EXAMPLE 2

A mixture of 100 parts of VAGH (supplied by Union Carbide Corporation), 15 parts of VMCH (supplied by Union Carbide Corporation), 15 parts of VYHH (supplied by Union Carbide Corporation), 35 parts of an epoxy resin (Epikote Resin #1001 supplied by Shell Chemical Co.) and 45 parts of a benzoguanamine resin was dissolved in a mixed solvent comprising 50 parts of methylethyl ketone, 50 parts of xylene, 50 parts of ethyl cellosolve and 20 parts of cyclohexane to form a primer composition having a solid content of 27%. In the same manner as described in Example 1, lid and tab materials were prepared by using this primer composition, and the peel strength was measured and the whitening resistance at the retort treatment was evaluated. The obtained results are shown in Table 1. It was found that the peel strength and the whitening resistance at the retort treatment were as good as in Example 1.

EXAMPLES 3 THROUGH 7

Primers shown in Examples 3 through 7 of Table 1 were coated, dried and cured on aluminum foils (100 microns in the thickness) and aluminum plates (0.4 mm in the thickness), which had been subjected to a surface treatment with phosphoric acid and chromic acid, in the same manner as described in Example 1. Lid and tab materials and adhesives were cmmbined as shown in Table 1, and the peel strength was measured and the whitening resistance at the retort treatment was evaluated. In each case, good results were obtained, and it was found that the products could sufficiently resist such severe conditions as retort sterilization conditions.

EXAMPLE 8

A lid material was prepared in the same manner as described in Example 1 except that an aluminum foil which had been subjected to a boehmite surface treatment was used as the lid substrate, and this lid material was combined with the same tab material as used in Example 1 and test pieces were prepared and tested in the same manner as described in Example 1. The obtained results were as good as shown in Table 1.

EXAMPLE 9

Test pieces were prepared in the same manner as described in Example 1 except that an aluminum foil which had been subjected to a chemical forming surface treatment was used as the lid substrate, and the test pieces were tested and evaluated. The obtained results were as good as shown in Table 1.

EXAMPLE 10

A mixture of 30 parts of a maleic anhydride-modified vinyl chloride/vinyl acetate copolymer (VMCH supplied by Union Carbide Corporation), 8 parts by weight of an epoxy resin (Epikote Resin #1001 supplied by Shell Chemical Co.), 5 parts of a phenolic resin and 5 parts of a benzoguanamine resin was dissolved in a mixed solvent comprising 30% by weight of xylene, 40% by weight of diisobutyl ketone and 30% by weight of diacetone alcohol, and 50 parts of a vinyl chloride resin powder (having a degree of polymriization of about 930) was dispersed in the solution to obtain a vinyl chloride organosol type primer. A lid material was prepared in the same manner as described in Example 1 by coating this primer on an aluminum foil which had not been subjected to a surface treatment. This lid material was combined with the same tab material as used in Example 1, and the peel strength was measured and the whitening resistance at the retort treatment was evaluated. The peel strength was sufficiently high even after the retort treatment. However, slight whitening was observed after the retort treatment, though no whitening was caused by the boiling treatment.

EXAMPLE 11

The peel strength was measured and the whitening resistance was evaluated in the same manner as described in Example 10 except that the primer coated on the aluminum foil as the lid substrate was composed solely of the maleic anhydride-modified vinyl chloride copolymer/vinyl acetate copolymer (VMCH). The peel strength and the whitening resistance at the boiling treatment were satisfactory, but after the retort sterilization, relatively prominent whitening was observed.

EXAMPLE 12

A maleic anhydride-modified polypropylene powder paint was electrostatically coated on an aluminum foil (100 microns in the thickness) and an aluminum plate (0.4 mm in the thickness), each of which had not been subjected to a surface treatment, so that the thickness after melting and leveling was 7±3 microns, and was heated and melted at 200° C. for 10 seconds by an infrared ray heating device. Then, lid and tab materials were prepared from the so-prepared coated aluminum foil and plate in the same manner as described in Example 1 and test pieces were prepared by using polypropylene as the adhesive. The peel strength and the whitening resistance at the boiling treatment were good, but slight whitening was observed after the retort treatment.

EXAMPLE 13

Test pieces were prepared by using a lid material and a tab material, each of which was not coated with a primer and was not subjected to a surface treatment, and also using maleic anhydride-modified polypropylene as the adhesive, and the peel strength was measured and the whitening resistance was evaluated. The peel strength was good, but the aluminum surfaces of the lid and tab were considerably blackened by the boiling treatment and retort treatment and the product could not be put into practical use.

EXAMPLE 14

The lid material prepared in Example 1 was punched, molded and scored, and a tab obtained by punching and molding the tab material prepared in Example 1 was heat-bonded to the obtained lid through a nylon type adhesive by high frequency induction heating so that the puch-tearing top end was located on scores to form a vessel lid having a shape shown in FIGS. 1 and 2. A frustoconical cup formed of a multi-layer plastic material according to the solid-phase air-pressure forming method, in which the inner diameter of the opening was 65 mm, the depth was 30 mm, the width of the flange portion was 3 mm and the thickness of the flange portion was 0.8 mm, was filled with 80 cc of water, and the above-mentioned lid was placed on the cup and heat-sealed thereto by high frequency induction heating. The sealed cup was subjected to the heat sterilization at 120° C. for 30 minutes. In a manner as shown in FIGS. 4-A and 4-B, the vessel was opened in the portion to be opened by using the tab. No change was observed in the bonding portion between the lid and the tab, and opening was accomplished smoothly along the scores with an initial opening force of 1.2 Kg and a maximum opening force of 2.1 Kg. After the opening operation, defects such as delamination and feathering were not observed in the opened portion.

COMPARATIVE EXAMPLE 1

A lid material was prepared in the same manner as described in Example 1 except that the aluminum foil as the lid substrate was not subjected to any of the surface treatments shown in Examples 1 through 9, and this lid material was combined with the same tab material as used in Example 1 and the peel strength was measured. The peel strength was very low even before the heat sterilization treatment and the product could not be used for the lid of the present invention.

COMPARATIVE EXAMPLE 2

A lid material was prepared in the same manner as described in Comparative Example 1 by using the same epoxyurea type primer as used in Example 3, and in the same manner as described in Comparative Example 1, the lid material was combined with the tab material and the peel strength was measured. It was found that the peel strength was 0.8 Kg/5 mm. After the retort treatment, the peel strength was so low that no substantial bonding was attained, and the product could not be put into practical use.

COMPARATIVE EXAMPLE 3

A lid material and a tab material were prepared in the same manner as described in Example 1 by using the same surface-treated aluminum foil and coating the same epoxyurea type primer as used in Example 3, and the peel strength test was carried out in the same manner as described in Example 1. It was found that the peel strength was very low and the product could not be put into practical use.

COMPARATIVE EXAMPLE 4

In the same manner as described in Example 13, a lid material and a tab material, each of which had not been subjected to any surface treatment and had not been coated with any primer, were used, and they were combined by using a polyester type adhesive. The peel strength was measured and the whitening resistance was evaluated. As shown in Table 2, the peel strength was low, and the surface of the aluminum foil was drastically blackened. The product could not be put into practical use.

COMPARATIVE EXAMPLE 5

The peel test was carried out in the same manner as described in Comparative Example 4 except that a nylon type adhesive was used instead of the polyester type adhesive used in Comparative Example 4. The peel strength was low and blackening of the aluminum foil surface was conspicuous, and the product could not be put into practical use.

COMPARATIVE EXAMPLE 6

In the same manner as described in Example 14, a vessel lid was prepared by using the same lid material and tab material as prepared in Comparative Example 2, and the lid was placed on a multi-layer plastic cup filled with water and heat-sealed thereto. The sealed vessel was heat-sterilized at 120° C. for 30 minutes. When opening of the vessel was tried by utilizing the tab, the tab was peeled from the bonding portion of the lid and it was found that opening by the tab was imposbile.

COMPARATIVE EXAMPLE 7

In the same manner as described in Example 14, a vessel lid was prepared by using the same lid material and tab material as prepared in Example 13, and the lid was heat-sealed to a multi-layer plastic cup filled with water. The sealed vessel was heat-sterilized at 120° C. for 30 minutes. Blackening of the lid surface was conspicuous and the vessel could not be used as a commercial product.

What is claimed is:

1. An easily-openable heat seal lid for sealing a vessel proper by forming a heat-sealed portion between the lid and the vessel proper, which comprises a laminate comprising at least an inner face member composed of a thermoplastic resin and a metal foil, wherein scores defining a portion to be opened are formed on the side inner than the portion to be heat-sealed so that the scores extend to the midway of the thickness direction of the metal foil, an opening tab is formed on the portion of the lid to be opened through a bonding fulcrum portion composed of a thermoplastic resin hot adhesive so that the push-tearing top end of the opening tab is located on the scores, and the peel strength between the opening tab and the lid in said bonding portion is at least 0.4 Kg/5 mm.

2. A heat seal lid as set forth in claim 1, wherein the heat seal inner face member is composed of a propylene resin and the inner face member is fusion-bonded to the metal foil through an acid- or acid anhydride-modified olefin resin in which the main constituent olefin monomer is propylene.

3. A heat seal lid as set forth in claim 1, wherein the heat seal inner face member is composed of a ethylene resin and the inner face member is fusion-bonded to the metal foil through an acid- or acid anhydride-modified olefin resin in which the main constituent olefin monomer is ethylene.

4. A heat seal lid as set forth in claim 1, wherein the thermoplastic resin hot adhesive is composed of a copolyester or a polyamide.

5. A heat seal lid as set forth in claim 1 or 3, wherein the opening tab and the laminate constituting the lid have a surface treatment layer and an adhesive primer layer on the sides to be bonded, respectively, and the tab and the laminate are heat-bonded to each other through said layers by the hot adhesive.

* * * * *